United States Patent [19]

Nava

[11] 4,119,018

[45] Oct. 10, 1978

[54] BENDING UNIT FOR A BENDING-GLUEING MACHINE

[75] Inventor: Giorgio Furtunato Nava, Milan, Italy

[73] Assignee: Vega S.p.A., Paderno Dugnano, Italy

[21] Appl. No.: 771,996

[22] Filed: Feb. 25, 1977

[30] Foreign Application Priority Data

May 28, 1976 [IT] Italy ..... 23727 A/76

[51] Int. Cl.[2] ..... B31B 1/54

[52] U.S. Cl. ..... 93/49 AC

[58] Field of Search ..... 93/49 AC, 49 R, 49 M, 93/52

[56] References Cited

U.S. PATENT DOCUMENTS

| | | | |
|---|---|---|---|
| 3,330,185 | 7/1967 | Annett et al. | 93/49 R |
| 3,377,926 | 4/1968 | Pröpper | 93/49 R |
| 3,901,134 | 8/1975 | Reizenstein et al. | 93/49 AC |

*Primary Examiner*—James F. Coan

*Attorney, Agent, or Firm*—Ralph W. Kalish

[57] ABSTRACT

This invention relates to a bending unit for a bending-glueing machine for bending the rear edge of a dinked workpiece advancing in rectangular direction.

7 Claims, 13 Drawing Figures

27
F1
J
CL
K
Q
Q̄
R
R8
R7
R6
R5
R4
R3
T1
T2
T3
T4
C1
C2
C3
C4
C5
C6
C7
C8
C9
R1
R2
D1
D2
D3 x 4
R9
R10
R11
R12
R13
R14
R15
R16
R17
R18
R19
R20
R21
R22
R23
R24
R25
R26
O.A. 1
O.A. 2
control clutch
control brake
+24 V
~ 0 V
~ 18 V
+ 8,2 V
+ 12 V
input cell 11
input 27
ground

BENDING UNIT FOR A BENDING-GLUEING MACHINE

DESCRIPTION OF THE PRIOR ART

Bending units of the above-mentioned typed are already known, in which rotating hooks are used to bend the rear edge of the dinked workpiece. These bending units are mechanically driven and the bending step carried out by means of the rotating hooks takes place in perfect synchronism with the motion of the feeder.

A drawback of this known type of machine consists in the length of the dinked workpiece being limited and depending essentially upon the circumference of the traveling path of the bending hooks. In addition, in the known machines, the dinked workpieces must advance at fixed and well-defined intervals. The adjustable feeders must therefore be perfectly synchronised with the pieces fed in at given time intervals.

Still further, the rotating hooks must be accurately synchronised with the motion of the feeders. Also, in the known machines, the distance between the single workpieces must be accurately fixed according to the circumference of the path of the rotating hooks, that is, the workpiece must be contained lengthwise within the peripheral development of the bending hooks.

A still further drawback of the known machines mentioned consists in the bending of the rear edge of the dinked workpieces of different lengths being practically impossible or, else, requiring long times for the setting up of the transporting and bending means of the machine.

BACKGROUND AND SUMMARY OF THE INVENTION

The principal object of this invention is a bending unit allowing to obviate the drawbacks characterising the preceding machines, making it possible to bend the dinked workpieces in a continuous manner without the necessity of accurate spacing between the single pieces, that is, allowing to feed the workpieces in contact with another or at irregular intervals.

A further object of this invention is a device allowing the bending of the rear edge of the dinked workpiece independent of the length of the single workpieces.

These and other objects are realised by means of a unit of the above-mentioned kind provided with means for the generation of signals, positioned in direction of feed of the dinked workpieces upstream of the bending arms, suitably designed to scan the passage of the rear end of the dinked workpiece and to transmit a signal to a control unit controlling then the starting of the motion of the arm or arms of the bending unit.

Further essential characteristics of this invention can be taken from the following description, the claims and the acompanying drawings.

The object according to this invention will now be described in detail on hand of a preferred embodiment thereof given by way of example without being limited thereto and as shown in the accompanying drawings in which:

DESCRIPTION OF THE PREFERRED EMBODIMENT

Figure 1:
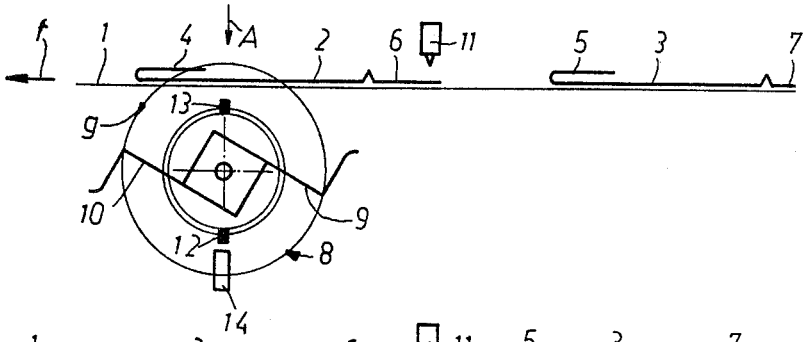
FIGS. 1 to 5 schematically show the bending unit in different positions of work.

As shown in FIGS. 1 to 5, a conveyor belt 1 part of the bending-glueing machine (not shown) feeds the dinked workpieces 2 and 3 in direction of the arrows f. The front edges 4, 6 of the dinked workpieces 2 and 3 are already bent, while the rear edges 6 and 7 are still to be bent. Below the conveyor belt 1 there is a bending unit indicated in generaly by 8. This bending unit 8 will be described in detail hereinbelow and comprises one or more bending arms 9, 10 which can be rotated in direction of the arrow g. In front of the bending unit 8 (in direction of the feed f) and above the conveyor belt 1 there is a means 11 capable "to scan" the moment the free end of the rear edges 6, 7 passes underneath the device 11. Preferentially the said device 11 consists of a photoelectric cell which, when its light beam is interrupted by the workpiece 2, 3 carried by the conveyor belt 1, does not emit any signal, but starts at once signalling when the light beam is no longer interrupted.

Figure 2:
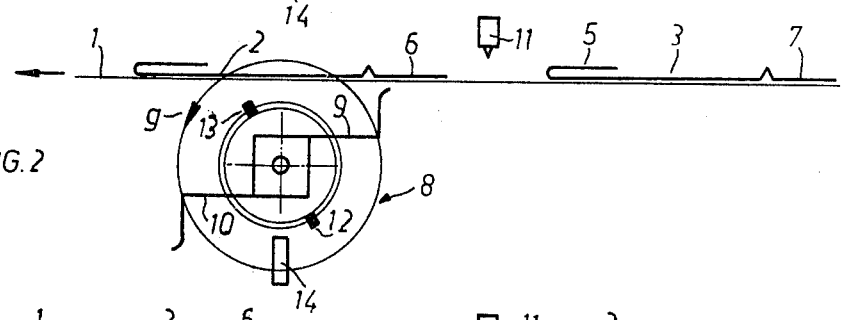
Figure 3:
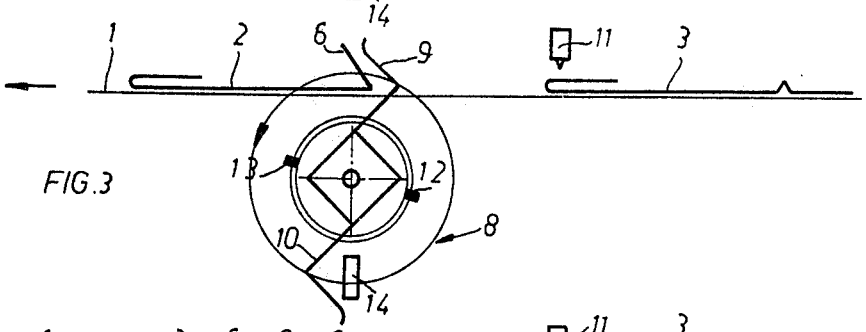
Figure 4:
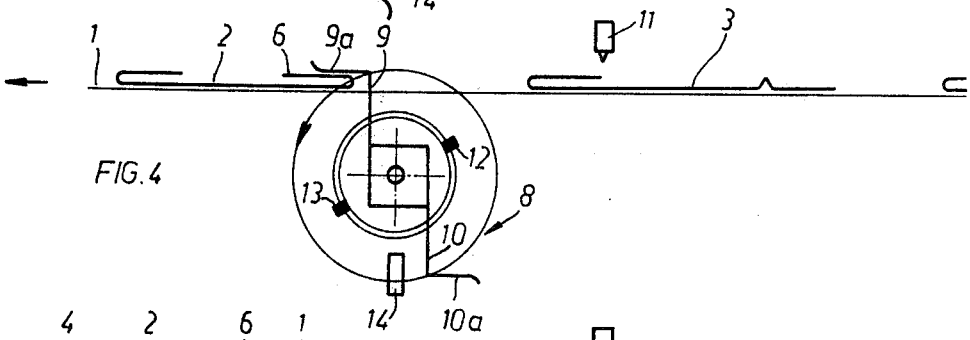
Figure 5:
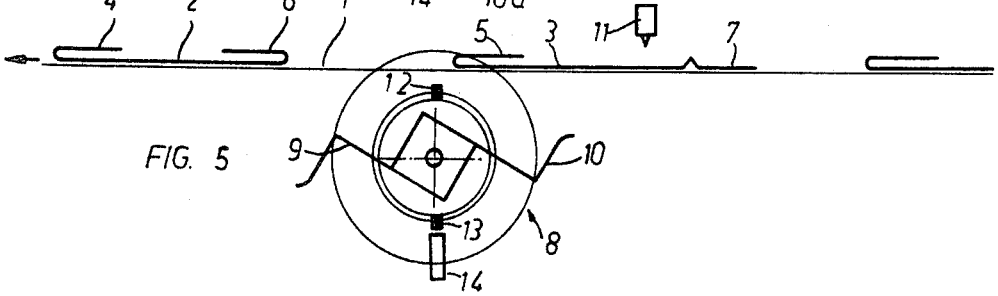
Figure 7:
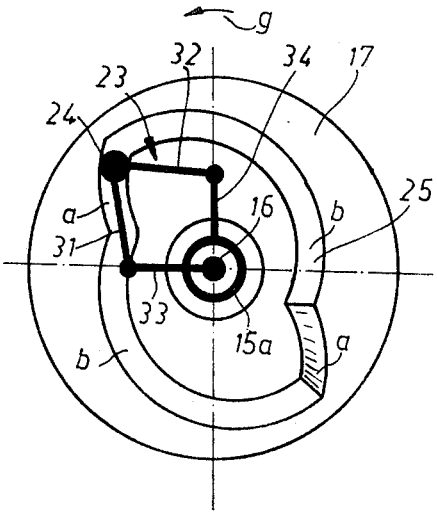
FIG. 7 shows a control unit in elevation along the line VII—VII of FIG. 6.
Figure 8:
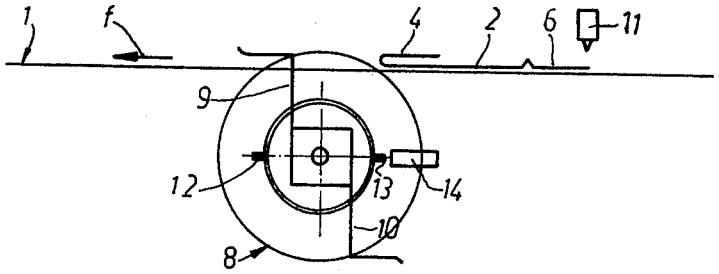
FIGS. 8 to 12 schematically show an ulterior bending unit in different positions of work as used in machines without the need of having to bend the edges of workpieces having a length in excess of the peripheral circumference of the bending hooks.
Figure 9:
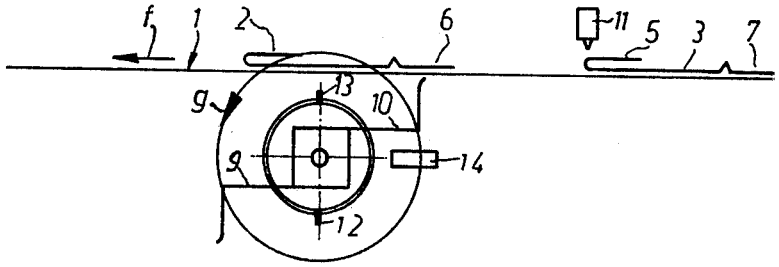
Figure 10:
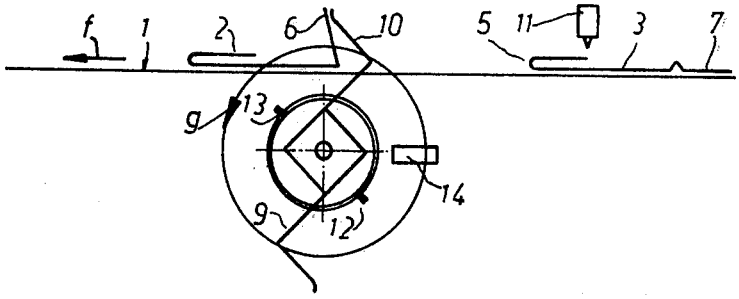
Figure 11:
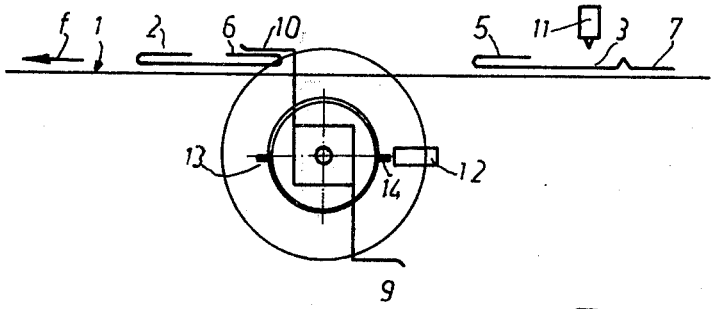
Figure 12:
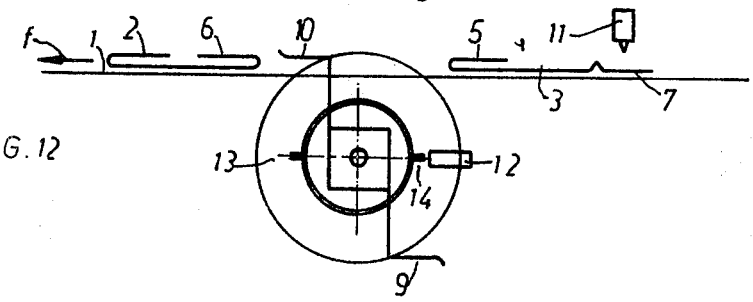
Figure 13:
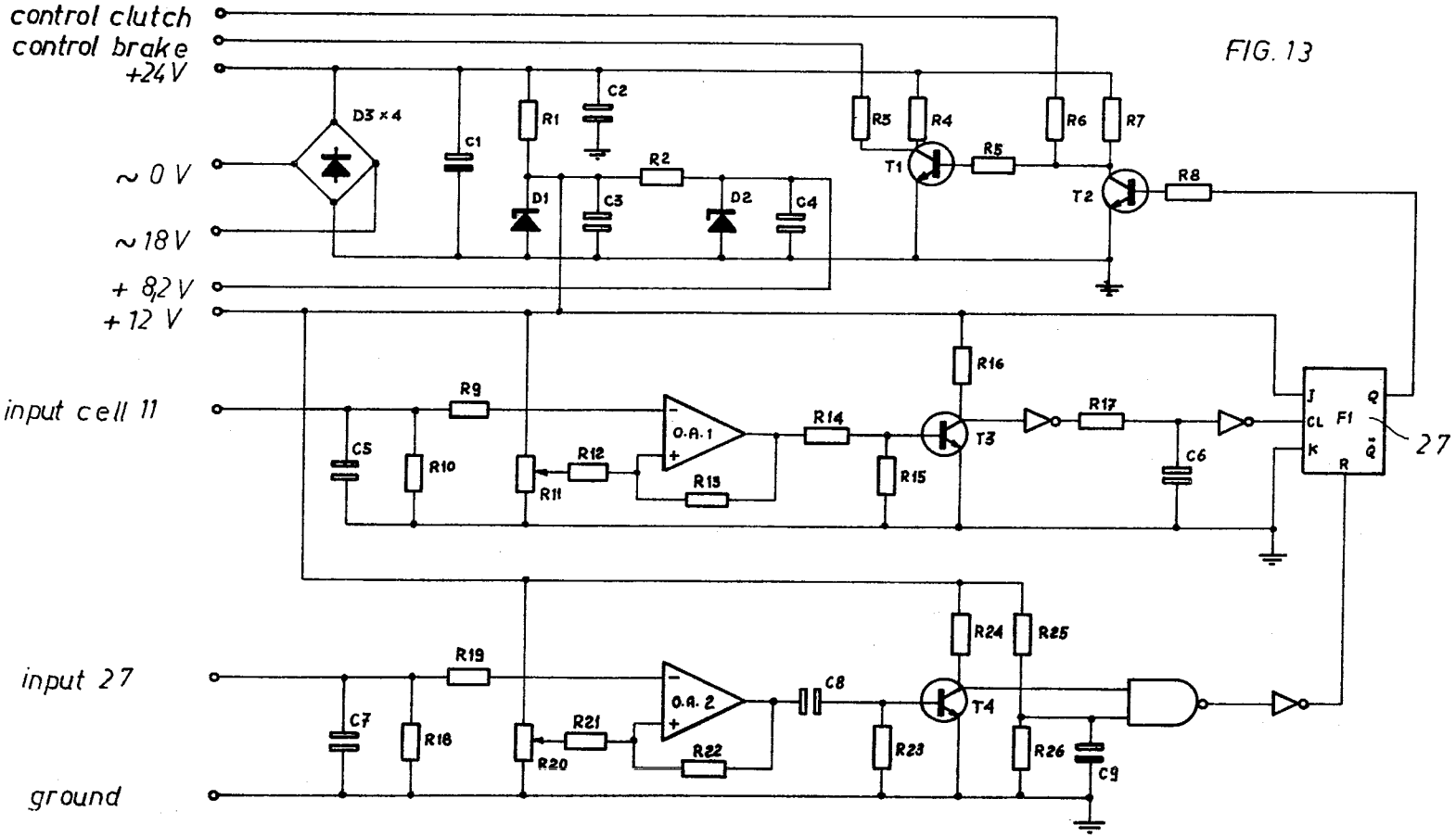
FIG. 13 illustrated the electronic control circuit.

The FIGS. 1 to 5 clearly show the single operating phases of the bending arms 9, 10. More in detail in FIG. 1 the arms 9, 10 result to be at standstill or waiting. The light beam of the photoelectric cell 11 is still interrupted by the rear edge 6 of the workpiece 2. In FIG. 2, the light beam of the photoelectric cell 11 is no longer interrupted by the rear edge 6 of the workpiece 2 and the bending arms 9, 10 controlled by means to be described in detail hereinafter, are moved in rotary direction according to arrow g. While the workpiece 2 continues to proceed on the belt 1 in direction of arrow f as shown in FIG. 3, the arm 9 of then bending unit 8 approached the rear edge 6 of the workpiece 2 folding it over in direction of feed f. After a movement of the arm 9 through about 90° (FIG. 4), the rear edge 6 is wholly bent over and the free end 9*a* of the arm 9 is now parallel to the conveyor belt 1, the workpiece 2, the edge 6. To prevent that the terminal 9*a* because of its rotational effect in direction of the arrow g could damage the dinked workpiece 2, a special cam control (FIG. 7) arresting the arm 9 for a given period of time allows the bent edge 6 to leave the space formed between the conveyor belt 1 and the end 9*a* of the arm 9. Thereafter, the bending unit continues its rotation in the direction of the arrow g to reach the standstill position indicated in FIG. 5. In this position reached after a movement through 180°, the arm 10 is ready for bending the rear edge 7 of the workpiece 3 now leaving the area underneath the photoelectric cell 11. The exact stopping position of the arms 9 and 10 is determined in cooperation with the electric contacts 12, 13 engaging a stop switch 14, for example an electromagnetic brake. The contacts 12, 13 are interlocked with the arms 9, 10; when approaching during their rotation the stop switch 14, the latter is excited and the movement of the bending unit 8 is immediately stopped and the arms are now in a predetermined position, for example as shown in FIGS. 1 and 5.

The bending unit 8, when realised as shown schematically in FIGS. 1 to 5, ensures the particular advantage of the bending phase being controlled by the workpiece itself, in particular by the rear end of the workpiece. For this reason the bending of the rear edges is now independent of the length of the workpiece, it being in fact the said rear end of the workpiece which acts on the "scanning" means 11, for example, a photoelectric cell, to insert the bending control. The said photoelectric cell in this case generates a signal when the light beam is no longer interrupted by the body of the workpiece, this signal now causing the rotation of the unit 8 and the motion of the arms 9, 10. As soon as the beam of the photoelectric cell 11 is again interrupted, for example by the workpiece 2, no signal is emitted and the bending unit 8 completes now its bending motion and stops then in the standstill position (FIGS. 1, 5) as determined by the contacts 12, 13 and the stop 14.

Figure 6:
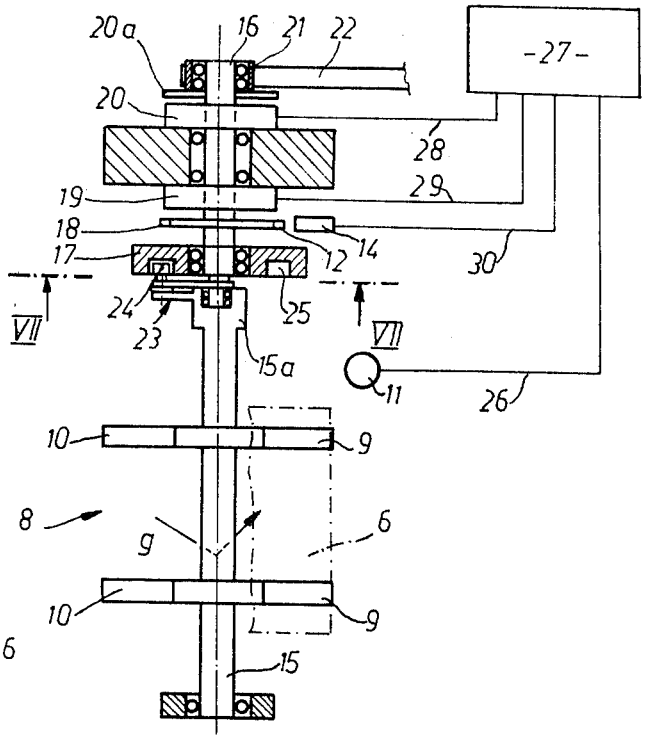
FIG. 6 schematically shows in elevation and part section in direction of arrow A of FIG. 1 the bending unit complete with the control unit.

A preferred embodiment of the bending unit 8 is shown in FIG. 6. This embodiment comprises in particular a shaft 15 horizontally positioned with respect to the conveyor belt 1 (not shown in FIG. 6) and so supported that it can make a rotary motion in direction of the arrow 6. The shaft 15 carries for example two or more hooks 9, respectively 10, spaced one from the other. One end of the shaft 15 is slightly thickened at 15*a* with embedded therein a further shaft 16 designed for making an idler movement. The shaft 16 carries a cam 17, a braking disk 18 interacting with a limit switch 14, a brake 19, in particular an electromagnetic brake and a clutch, in particular an electromagnetic clutch 20 moving a disk 20*a* connected to pulley 21 rotated by means of a chain or belt 22. The thickened part 15*a* of the shaft 15 is still further connected to a knuckle lever system 23 (FIG. 7) which, through a roller 24, slides inside the groove 25 of the cam disk 17. As soon as the photoelectric cell 11 is clear from the end 6 of a workpiece schematically indicated by the hatched line, the cable 26 transmits a signal to the control system 27 where the signal is now processed. Successively, the control system 27 transmits through the cable 28 a signal to the clutch 20 transmitting in turn through the rotating pulley 21 and the disk 20*a* connected thereto a movement to the shaft 16 and therewith to the arms 9 and 10 for ensuring the execution of the bending phase as shown in FIGS. 1 to 5. At the end of the bending phase a signal transmitted by the control system 27 and the cable 29 reaches the brake 19 slowing down the motion of the arms 9 and 20 until the latter are stopped in the rest position shown in FIG. 1 by the action of the limit switch 14 interacting with the limit contacts 12.

Providing for example two limit contacts 12, the bending phase of each arm 9, rispectively 10 corresponds to 180°. The limit switch 14 is controlled through the cable 30 connected to the control system 27.

To obtain a new bending phase the photoelectric cell 1 must send again a signal, through cable 26, to the control system 27.

The device according to this invention, comprises a cam mechanism 17 of a particular shape, controlling the movement of the hooks 9, 10 in such a manner that in the phase shown in FIG. 4, the end 9*a* and respectively during the successive bending cycle the end 10*a* of the arms 9, 10 remain for a given time interval at rest, making sure that the end or rear edge 6 of the workpiece 2 is allowed to leave the space formed between the arm 9*a* and the conveyor belt L and thus preventing that the end 9*a* of the arm 9 could damage the just bent edge. As soon as the bent edge 6 leaves the zone of the end 9*a* of the arm 9, the latter continues its travel to reach its rest position as shown in FIG. 5.

For this purpose the cam 17 is provided with a groove 25 housing a roller 24 connected to two articulated arms 31, 32 which, in turn are connected to two further articulated arms 33, 34. The free end of the arm 33 is connected to the shaft 16, that of the arm 34 connected to the thickened part 15*a*. This particular lever system 23 ensures that, during the critical phase illustrated in FIG. 4, the shaft 16 undergoes a rotary movement which however is not transmitted to the thickened part 15*a* of the shaft 15 and the arms 9, 10. This stopping of the arms 9 and 10 is obtained when the roller 24 moves in the part (*a*) of the groove 25; with the roller 24 when moving in the part (*b*) of the groove the arms undergo a rotary motion.

FIGS. 8 to 12 show a simplified bending unit for use in bending-glueing machines which do not require the bending of the rear edges of workpieces having a length in excess of the peripheral path of the bending hooks.

The constructional elements of this form of execution essentially being the same as used in FIGS. 1 to 5, the same reference numbers are used.

As already mentioned, the unit shown in FIGS. 8 to 13 is limited to a given length of the workpiece to be bent. In this case, the control cam together with its lever system is eliminated and the shaft is integrally fixed to the brake disk. This results in a bending cycle as shown in FIGS. 8 to 12, complete with a control system receiving the electrical pulses emitted by the photoelectric cell and by a limit switch. The control system in turn emits electrical signals directed to the already described electromagnetic clutch interacting with an electromagnetic brake. The said means interact by means of a drive pulley with the shaft carrying the rotating hooks for the bending of the rear edge of the workpieces.

When in rest position, the hooks 9, 10 stop in vertical position and the stopping means 14, interacting with the contacts 12, 13, in horizontal position. The operation of this type of bending unit 8 essentially corresponds to that already described hereinbefore with the difference that the hooks 9, 10 always stop in vertical position, projecting beyond the conveyor belt 1.

This device, too, allows to insert the work pieces 2, 3 into the machine without the need of fixed and accurate distances between the single workpieces; the conveyors do not need a timed insertion and the rotation of the hooks must not necessarily be in phase with the conveyor controls because the photoelectric cell 11 supplies the driving impulse in function of the movement of the workpiece.

We claim:

1. The combination with conveying means for successively presenting a workpiece having a foldable rearward end for bending into the direction of travel of said conveying means, said workpiece projecting laterally beyond said conveying means, means for effecting continual travel of said conveying means, of a device for bending said foldable rearward end portion comprising a main shaft disposed beneath said conveying means in axially transverse relationship thereto, at least one pair of bending arms carried on said shaft for rotation thereof and being spaced apart axially of said shaft and projecting beyond opposed sides of said conveying means, a control shaft engaged to one end of main shaft in axially aligned relationship thereto, a signal receiving and processing unit for emission of processed energizing signals, clutch means connected to said signal processing unit for actuation by processed emitted signals for causing rotation of said shafts whereby the bending arms are rotated to engage the overlying workpiece foldable rearward end and carries same into bent condition, cam means interconnecting said control shaft and said main shaft for effecting dwell of said bending arms upon termination of said bending action for a predetermined interval and for permitting rotation of said main shaft thereafter, means for sequentially terminating rotation of said main shaft when said bending arms have moved a predetermined distance beyond bending position, and signal producing means energizing said processor when the next succeeding workpiece is in predetermined relation to said not stopped arms.

2. The combination as defined in claim 1 and further characterized by said clutch means being an electromagnetic friction clutch, there being an electromagnetic brake engaged on said control shaft, means connecting said brake to said signal processor for slowing rotation of said control shaft at a predetermined position of rotation of said bending arms.

3. The combination as defined in claim 2 and further characterized by said signal producing means comprising an optical device for signal production during intervals between the succeeding advancing workpieces traveling on said conveyor means.

4. The combination as defined in claim 3 and further characterized by said optical device being a photoelectric cell having a light signal emitter located upwardly above, and outwardly of, said conveying means, a light signal receptor cell located alignedly outwardly and below said light emitter, and circuit means connecting said light receptor cell to said signal processor.

5. The combination as defined in claim 2 and further characterized by said means for terminating rotation of said main shaft being a limit switch, a corresponding switch deactuator element carried on said electromagnetic brake engageable with said limit switch to assure stoppage of said bending arms in preselected relationship to the next succeeding advancing workpiece.

6. The combination as defined in claim 5 and further characterized by means connecting said limit switch and said signal processor for deenergizing same pending reception of the next succeeding signal from said signal producing means.

7. The combination as defined in claim 1 and further characterized by said cam means comprising a cam having a camming groove formed therein carried on said control shaft, said groove containing an irregular operating section, a cam follower engaged in said groove for travel therethrough, and first and second lever elements connecting said cam follower to said control shaft and said main shaft respectively, whereby when said cam follower is within said irregular operating section said main shaft rotation is arrested to effect said dwell while said control shaft is free to rotate.

* * * * *

UNITED STATES PATENT OFFICE

CERTIFICATE OF CORRECTION

Patent No. 4,119,018 Dated October 10, 1978

Inventor(s) Giorgio Fortunato Nava

It is certified that error appears in the above-identified patent and that said Letters Patent are hereby corrected as shown below:

Col. 5, Claim 1, line 16, after "said" and before "stopped" change "not" to ---now---.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*